US005195338A

United States Patent [19]

Russo

[11] Patent Number: 5,195,338

[45] Date of Patent: Mar. 23, 1993

[54] LIQUID DETERGENT DISPENSING APPARATUS FOR WASHING MACHINES

[75] Inventor: Fernando Russo, Pordenone, Italy

[73] Assignee: Zanussi Elettrodomestici S.p.A., Pordenone, Italy

[21] Appl. No.: 738,909

[22] Filed: Aug. 1, 1991

[30] Foreign Application Priority Data

Aug. 30, 1990 [IT] Italy ..... 45751A90

[51] Int. Cl.[5] ..... D06F 39/02

[52] U.S. Cl. ..... 68/12.18; 68/17 R; 68/12.03; 222/651

[58] Field of Search ..... 68/12.18, 17 R, 207, 68/17 R, 12.03; 134/57 D, 56 D, 58 D; 222/651

[56] References Cited

U.S. PATENT DOCUMENTS

| | | | |
|---|---|---|---|
| 2,570,148 | 10/1951 | Neuroth et al. | 68/12.18 |
| 3,044,285 | 7/1962 | Koplin | 68/12.18 |
| 3,510,026 | 5/1970 | Wright | 68/12.18 |
| 3,721,908 | 3/1973 | Jurjano | 361/195 X |
| 3,771,333 | 11/1973 | Jurjans | 68/12.18 |
| 3,804,297 | 4/1974 | Jurjans | 68/12.18 |
| 4,509,543 | 4/1985 | Livingston et al. | 134/57 D |
| 4,756,321 | 7/1988 | Livingston et al. | 68/12.18 |

FOREIGN PATENT DOCUMENTS

| | | | |
|---|---|---|---|
| 232518 | 11/1986 | Fed. Rep. of Germany | 68/12.18 |
| 63-51897 | 3/1988 | Japan | 68/12.18 |

*Primary Examiner*—Frankie L. Stinson
*Attorney, Agent, or Firm*—Wenderoth, Lind & Ponack

[57] ABSTRACT

A liquid detergent dispensing apparatus is for use in a washing machine and includes an oscillator which generates a pulse signal having a frequency corresponding to a quantity of liquid detergent to be added to the wash tank of the washing machine. A metering pump, which is for dispensing a constant delivery quantity of detergent from a reservoir, is selectively driven for a period of time corresponding to the frequency of the pulse signal generated by the oscillator. Further, the metering pump is selectively driven in response to an operating state of an actuator of a multicompartment detergent container and in response to an operating state of a heating element of the washing machine.

4 Claims, 1 Drawing Sheet

LIQUID DETERGENT DISPENSING APPARATUS FOR WASHING MACHINES

BACKGROUND OF THE INVENTION

1. Field of the Invention

The present invention relates to a liquid detergent dispensing apparatus for use in washing machines, and more particularly, to a liquid detergent dispensing apparatus for automatically metering and dispensing variable quantities of detergent products during various phases or cycles of a washing sequence of a washing machine.

2. Description of the Related Art

Washing machines, particularly garment washing machines and dishwashing machines, are known which provide a drawer like or similar detergent container that is subdivided into plural separate compartments each adapted to contain pre-established, metered quantities of powder or liquid detergent products to be added during different phases or cycles of an on-going washing sequence. The container is in communication via a flexible conduit with the machine's wash tub or tank which is disposed below the container. Further, such detergent containers are generally provided with suitable control apparatus which is actuated by the machine's program/sequence control device. The machine is adapted to selectively apply an inlet water flow through a corresponding compartment of the detergent container during the various phases or cycles of a selected washing sequence to thereby flush off and convey into the machine's wash tub or tank a pre-established quantity of powder or liquid detergent contained in the compartment through which the inlet water flow was applied.

Washing machines are also known which include at least one storage reservoir that is capable of containing a sufficient supply of a liquid detergent to permit several washing sequences to be carried out, in contrast to the previously described detergent container which is adapted for carrying out only a single washing sequence at a time. The storage reservoir is provided in communication with the machine's was tub or tank and includes electro-magnetic shut-off valves or other suitable control devices that are actuated to open or close responsive to the machine's program/sequence control device. Such a reservoir is further associated with a known dispenser which is adapted to allow pre-established, constant quantities of liquid detergent to be added to the wash tub or tank of the machine during the pre-wash and wash phases of the washing sequence to be carried out by the machine, together with the necessary water inflow amounts of the respective wash phases.

Although the above-described known dispensers and washing machines are certainly capable of operating in a satisfactory and reliable manner, such dispensers and washing machines have a significant drawback in that it is necessary to provide program/sequence control devices that are specially designed and to identify the various pre-wash, soak and wash phases of the corresponding selected washing sequence, to thereby enable command of the appropriate quantity of liquid detergent to be selectively added to the wash tub or tank during each of the phases. A further drawback in such known dispensers and washing machines is that such are adapted to add only pre-defined, fixed quantities of liquid detergent, regardless of the actual amount of the wash load (i.e. garments or dishes) existing in the wash tub or tank. As such, optimum consumption of the liquid detergents cannot be realized, and as an additional consequence, consumption of the electric energy necessary to heat the resulting wash liquid solutions is relatively increased.

SUMMARY OF THE INVENTION

It is an object of the present invention to provide a detergent dispensing apparatus for a washing machine which overcomes the above-discussed drawbacks of the known liquid dispensers and washing machines.

The liquid detergent dispensing apparatus of the present invention is adapted for use in conjunction with conventional type program/sequence control devices and is adapted to automatically and reliably identify different pre-wash, soak and wash phases of each single selected washing sequence, without requiring the program/sequence control device to be specially modified or adapted, thus avoiding the use of relatively complex and expensive control devices, and thereby providing for the regulation in advance of precise dosages of liquid detergent to be added as a function of the actual amount of the wash load (garments or dishes) to be introduced into the machine's wash tub or tank in connection with the selected washing sequence.

BRIEF DESCRIPTION OF THE DRAWING

The liquid detergent dispensing apparatus of the present invention will be further described by way of a non-limiting example with reference to the accompanying drawing in which.

DETAILED DESCRIPTION OF THE PREFERRED EMBODIMENT

Figure 1:
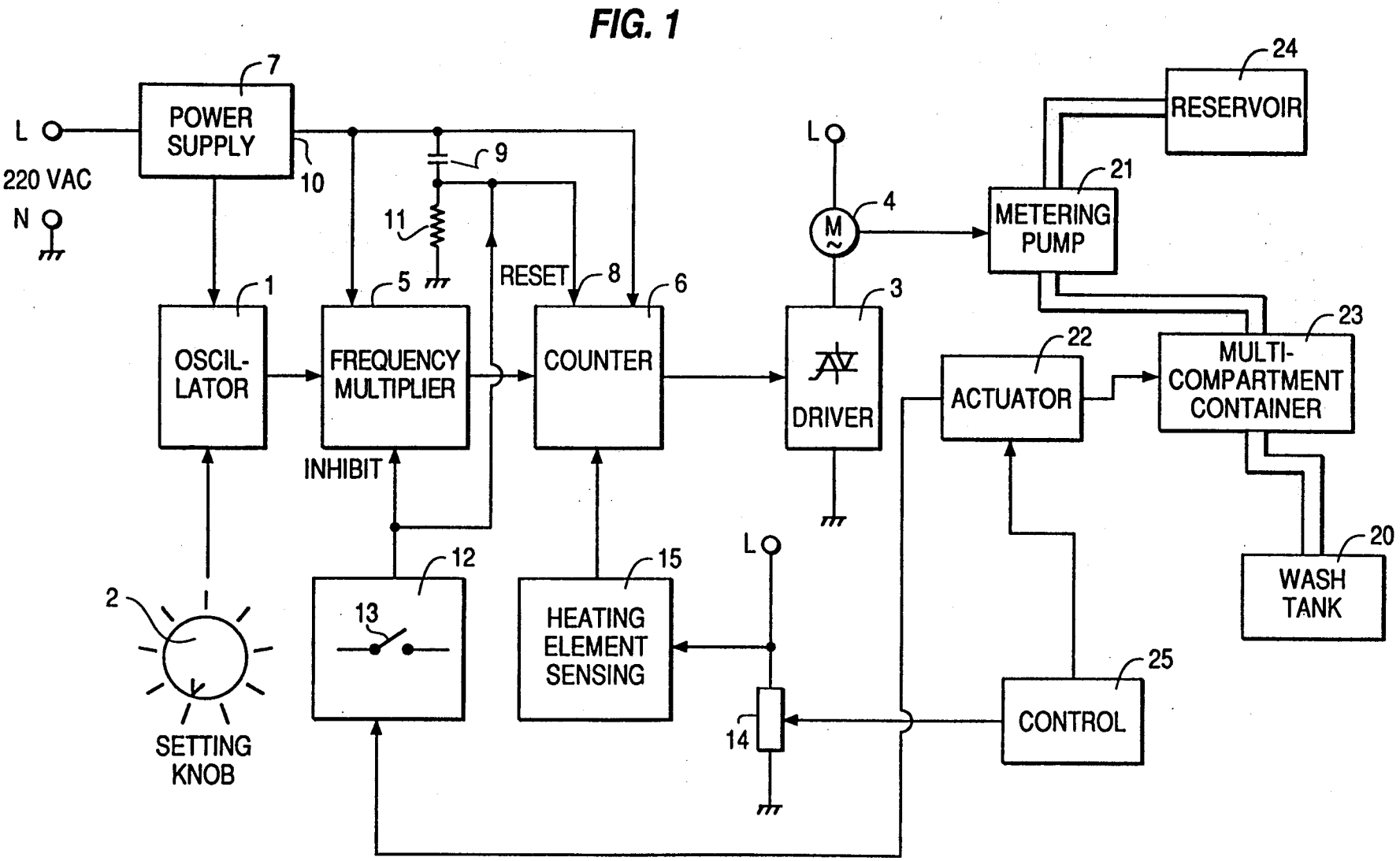
FIG. 1 illustrates a block diagram of the liquid detergent dispensing apparatus according to the present invention.

A liquid detergent dispensing apparatus of the present invention is adapted for installation in washing machines, particularly garment washing and dish washing machines. Such machines are provided with a wash tub or tank communicating with a detergent container having plural separate compartments. Each compartment is adapted to contain a powder or liquid detergent product required for carrying out a phase or cycle of the selected washing sequence of the machine. Further, the machine is provided with at least one dispenser/reservoir containing a quantity of liquid detergent as required for carrying out the pre-wash and wash phases of several washing sequences of the machine. The dispenser/reservoir is in communication with the detergent container preferably via at least one constant-delivery metering pump which is adapted to selectively add quantities of the liquid detergent to the wash tub or tank which are exactly proportional to the duration of time during which the pump is switched on.

Such machines are further provided with a conventional electro-mechanical or electronic program/sequence control device which allows for a plurality of washing sequences to be duly carried out by the machine as selected in advance by the user. The user selects the washing sequence by properly setting the appropriate cycle selectors and control elements provided on the machine's control panel.

Particularly, the program/sequence control device interacts, via clearance-compensated linkage systems, with an actuating member (i.e. a sliding piston, a rotary disc or similar device) which is provided in the detergent container and which is capable of being displaced into different adjustment positions or settings (responsive to the program/sequence control device) during each phase of the selected washing sequence. By controlling the actuating member in such a manner, the detergent products contained in the corresponding compartments of the detergent container are added selectively into the wash tub or tank.

Having described the environment in which the present invention is applicable, the liquid detergent dispensing apparatus of the present invention will now be described in detail with reference to FIG. 1.

The liquid detergent dispensing apparatus of the present invention includes an oscillator 1 for generating a constant-level square-wave signal. The frequency of the square-wave signal output by the oscillator 1 is variable responsive to a setting of the adjustment knob 2. The adjustment knob 2 has pre-fixed adjustment settings and is provided on the machine's control panel. The adjustment knob 2 is turned to an appropriate adjustment setting prior to starting a corresponding selected washing sequence, the setting being maintained throughout the selected washing sequence. The setting position of the adjustment knob 2 corresponds to an actual quantity of liquid detergent which is to be added to the wash tub or tank 20 in the pre-wash and wash phases of the selected washing sequence.

The liquid detergent dispensing apparatus further includes a driver 3, of a conventional type, for driving an electric motor 4 of the previously described liquid-detergent metering pump 21. The driver 3 is operatively connected to the oscillator 1 via a frequency multiplier 5 and a digital electronic counter 6. The frequency multiplier 5 generates a square-wave signal having a frequency equal to a pre-defined multiple of the frequency generated by the oscillator 1, and the electronic counter 6 is for counting the pulses of the square-wave signals generated by the frequency multiplier 5.

The liquid detergent dispensing apparatus further includes a power supply 7 connected to a main power supply of the washing machine and supplying operating power to the oscillator 1, the frequency multiplier 5, and the electronic counter 6.

More particularly, the power supply 7 is connected at a reset input 8 of the electronic counter 6 via an RC circuit consisting of a capacitor 9 (connected to the output 10 of the power supply 7) and a resistor 11 (connected to ground), so as to generate a peak voltage adapted to reset the electronic counter 6 each time the power supply 7 is switched on.

The frequency multiplier 5 is also connected to a logic electronic circuit 12 which is associated with an electric micro-switch 13 connected to the machine's electric circuitry and capable of being actuated between opened and closed states responsive to the previously described actuator member 22 of the detergent container 23 as it is displaced from one to the other one of its adjustment settings in which the liquid detergents products are respectively added to the wash tub or tank 20 during the pre-wash and wash phases of each selected washing sequence. Particularly, the logic circuit 12 detects the functional state of the micro switch 13 (i.e. whether the micro switch 13 is switched on or off), and outputs a corresponding logic state (i.e. "0" or "1"), the output being applied to the frequency multiplier 5. As such, the logic circuit 12 enables and inhibits the operation of the frequency multiplier 5 when the adjustment setting of the actuator member 22 of the detergent container 23 is displaced during the pre-washed phase and when the adjustment setting of the actuator member 22 of the detergent container 23 is displaced during the wash phase of the selected washing sequence.

When the frequency multiplier 5 is enabled by the logic circuit 12, the frequency multiplier 5 generates a square-wave signal having a frequency which is a multiple of the frequency of the signal generated by the oscillator 1, and as such, the electronic counter 6 counts the pulses of the frequency multiplied signal. On the other hand, when the frequency multiplier 5 is inhibited by the logic control circuit 12, the electronic counter 6 counts the pulses of the square-wave signal (a non-frequency multiplied signal) which is generated directly by the oscillator 1.

The logic circuit 12 is also connected to the reset input 8 of the electronic counter 6, and the electronic counter 6 is connected to a heating element 14 via an electronic sensor 15. The heating element 14 is provided for heating the wash liquid solution of the machine's wash tub or tank 20. The electronic sensor 15 is for detecting whether the heating element 14 is switched on or off with respect to the electric circuitry of the machine and for converting the thus detected state of the heating element 15 into a corresponding logic state which is applied to the electronic counter 6. The electronic counter 6 is enabled by the electronic sensor 15. More particularly, the electronic counter 6 is enabled (i.e. is switched on) when the heating element 14 is switched on, and the electronic counter 6 is inhibited (i.e. switched off) when the heating element 14 is switched off.

The operation of the liquid detergent dispensing apparatus of the present invention having the above-described configuration will now be described.

Initially, after having set the desired washing sequence via the program/sequence control device 25 and the setting of the adjustment knob 2 in accordance with the nature and degree of soiling and the quantity of the wash load, the machine is started and begins to operate by carrying out the pre-wash phase of the selected washing sequence. It is noted that the setting of the adjustment knob 2 is carried out to achieve optimum consumption of the liquid detergent and optimum consumption of the electric energy required to heat up the washing solution, the setting of the adjustment knob 2 establishing a quantity of liquid detergent product to be added during the washing sequence.

The program/sequence control device 25 of the machine then causes the actuator member 22 of the detergent container to be automatically displaced into an appropriate adjustment setting provided for the pre-washed phase in which water is gradually let into the wash tub or tank. However, for reasons described hereinafter, the liquid detergent stored in the dispenser/reservoir 24 of the machine is not yet dispensed into the wash tub or tank 20. The action of the actuator member 22 of the detergent container 23 actuates the micro-switch 13 which in turn causes the logic circuit 12 to enable the frequency multiplier 5 as discussed above. Further, during this initial pre-wash phase of the washing sequence, the program/sequence control device 25 maintains the heating element 14 in an off state to allow a specified amount of water to enter the wash tub or tank 20. As such, the electronic sensor 15 will detect that the heating element 14 is in a deenergized state, and, therefore, will inhibit the operation of the electronic counter 6 (i.e. the electronic counter 6 will be in an off state). The electronic counter 6 will have in turn been reset by the voltage peak generated by the RC circuit 9, 11 upon the energizing of the electronic components by the power supply 7.

Further, the frequency multiplier 5 will start generating square-wave pulses having a frequency which is a multiple of the frequency of the pulses generated by the oscillator 1. However, since the electronic counter 6 is in an inhibited state, the frequency multiplied pulses of the frequency multiplier 5 are not counted by the electronic counter 6. Under this state, the electronic counter 6 will maintain the driver 3 of the electric motor 4 of the liquid-detergent metering pump in an off state, whereby no liquid detergent will be added into the machine's wash tub or tank 20.

Thereafter, the heating element 14 is switched on and energized by the program/sequence control device 25 when the inlet water reaches a predetermined level within the wash tub or tank 20. As such, the electronic sensor 15 will detect the energized state of the heating element 14 and, accordingly, will output a logic state for enabling the electronic counter 6. Then, the electronic counter 6 will cause the electric motor 4 of the liquid-detergent metering pump 21 to be activated responsive to the driver 3. This will result in the addition of liquid detergent into the water filled wash tub or tank 20. Also, at the same time, the electronic counter 6 upon being enabled will count the pulses of the frequency multiplied square-wave signals output by the frequency multiplier 5. Then, when the electronic counter 6 has completed counting of a specified number of pulses of the frequency multiplied square-wave signals generated by the frequency multiplier 5 and set via the adjusting knob 2 (i.e. at such time the entire quantity of liquid detergent intended for the pre-wash cycle has been actually added into the wash tub or tank 20 for mixing with the pre-filled water), the electronic counter 6 will automatically cause the driver 3 to be deactivated, thereby causing the motor 4 of the liquid detergent metering pump 21 to be deactivated, and as a consequence, discontinuing the addition of the liquid detergent product into the wash tub or tank 20.

In this manner, the washing machine carries out the pre-wash cycle, and at the end of this cycle, the entire volume of the wash solution contained in the wash tub or tank of the machine is discharged from the machine, and the heating element 14 is temporarily switched off by the program/sequence control device 25. As such, a condition is created in which the washing machine is set and ready for proceeding with the washing sequence by carrying out the next washing phase.

Before the next washing phase is actually initiated, the program/sequence control device 25 acts to cause the actuating member 22 of the detergent container 23 to be displaced in another control setting. That is, a quantity of liquid detergent intended for the main wash phase is added into the wash tub or tank 20, and the control of the actuator member 22 actuates the microswitch 13. That is, in the described example, the microswitch 13 is placed in an ON state, and in response the logic state of the logic circuit 12 is changed to thereby inhibit the operation of the frequency multiplier 5. The frequency multiplier 5 is in an inhibited or off state and the electronic counter 6 is reset. As such, the apparatus is in a state ready for control of the addition of the liquid detergent products into the wash tub or tank 20 during the main wash phase of the washing process.

Then, the main wash phase is initiated by applying fresh water into the wash tub or tank 20 until a predetermined fill level is reached. During this filling of the wash tub or tank 20, the heating element 14 is in a deenergized state and, accordingly, the electronic counter 6, the driver 3 and the electric motor 4 of the liquid detergent metering pump are switched off. As such, a condition is created in which liquid detergent products are not permitted to be dispensed and added into the wash tub or tank 20.

Thereafter, when the predetermined water fill level has been reached, the heating element 14 is energized, thus enabling the electronic counter 6 (via the electronic sensor 15). As a result, the electric motor 4 of the liquid detergent metering pump 21 is switched on via the driver 3, whereby liquid detergent will start to be dispensed and added into the wash tub or tank 20 for the main wash phase.

Under these circumstances, the electronic counter 6 will initiate a count of the pulses of the square-wave signals generated directly by the oscillator 1 (since the frequency multiplier 5 is inhibited or turned off). As soon as the specified pulses of the square-wave signal have been counted, i.e. when the entire quantity of the electric detergent product intended for the main wash phase has been added to the water filled wash tub or tank 20, the electronic counter 6 causes the electric motor 4 of the liquid-detergent metering pump 21 to be automatically switched off via the driver 3, thereby discontinuing the addition of the liquid detergent into the wash tub or tank 20.

Thereafter, the program/sequence control device 25 acts to control the wash execution, in a conventional way, of further possible wash cycles and phases and subsequent rinsing phases of the selected washing sequence, without further actuation of the liquid-detergent metering pump 21 and, as a consequence, without further addition of liquid detergent products into the wash tub or tank 20, until such time the electronic counter 6 is again reset and made ready to operate in the above-described manner for carrying out further washing sequences of the washing machine.

What is claimed is:

1. A liquid detergent dispensing apparatus for use in a washing machine, the washing machine including a wash tank, a liquid detergent reservoir, and a multicompartment detergent container in fluid communication with the wash tank and in fluid communication with the detergent reservoir via a metering pump, the multicompartment detergent container having an actuator associated therewith which is responsive to a control device to place at least one compartment of the multicompartment detergent container in fluid communication with the wash tank, the washing machine further including a heating element which is responsive to the control device to heat a solution of the wash tank, the washing detergent dispensing apparatus comprising:

setting means for setting a quantity of liquid detergent to be added to the wash tank, wherein said setting means includes an oscillator for generating a first pulse signal having a frequency which is variable, the frequency of the first pulse signal corresponding to the quantity of liquid detergent to be added to the wash tank; and, drive means, operatively coupled to the heating element and the metering pump and the actuator and said setting means, for selectively driving the metering pump for a period of time corresponding to the quantity of liquid detergent set by said setting means in response to an operating state of the actuator and the heating element;

wherein said drive means comprises (a) a frequency multiplier means, operatively coupled to said oscillator, for operating in an enabled state to generate a second pulse signal having a frequency which is a multiple of the frequency of the first pulse signal generated by said oscillator, (b) logic circuit means, operatively coupled to said frequency multiplier means and the actuator, for enabling said frequency multiplier means in response to the operating state of the actuator, (c) electronic counter means, operatively coupled to said frequency multiplier means, for operating in an enabled state to count the pulses of the second pulse signal generated by said frequency multiplier means, (d) sensor means, operatively coupled to said electronic counter means and the heating element, for enabling said electronic counter means in response to an operating state of the heating element, and (e) metering pump drive means, operatively coupled to said electronic counter means and the metering pump, for operating in an enabled state to cause the metering pump to dispense liquid detergent from the reservoir in response to an output from said electronic counter means, wherein the electronic counter means enables said metering pump drive means while counting a number of pulses generated by said frequency multiplier means while being enabled by said sensor means.

2. An apparatus as recited in claim 1, wherein said electronic counter means disables said metering pump drive means upon counting a specified number of pulses of said second pulse signal.

3. An apparatus as recited in claim 2, wherein said electronic counter means includes a reset input operatively coupled to said logic circuit means and operatively coupled to a power supply device via an RC circuit for generating a peak voltage to reset the electronic counter means each time the power supply device is switched on.

4. An apparatus as recited in claim 1, wherein said electronic counter means operates in the enabled state to count the pulses of the first pulse signal generated by said oscillator when said frequency multiplier means is disabled by logic circuit means.

* * * * *